US010351987B2

(12) United States Patent
Marioni

(10) Patent No.: US 10,351,987 B2
(45) Date of Patent: Jul. 16, 2019

(54) DISCHARGE/RECIRCULATION SYSTEM FOR HOUSEHOLD APPLIANCES

(71) Applicant: ASKOLL HOLDING S.R.L. a socio unico, Povolaro di Dueville (Vicenza) (IT)

(72) Inventor: Elio Marioni, Dueville (IT)

(73) Assignee: Askoll Holding S.r.l.—a socio unico, Dueville (Vicenza) (IT)

( * ) Notice: Subject to any disclaimer, the term of this patent is extended or adjusted under 35 U.S.C. 154(b) by 0 days.

(21) Appl. No.: 15/708,692

(22) Filed: Sep. 19, 2017

(65) Prior Publication Data

US 2018/0080167 A1 Mar. 22, 2018

(30) Foreign Application Priority Data

Sep. 21, 2016 (CN) ..... 2016 1 0839945

(51) Int. Cl.

| | |
|---|---|
| ***A47L 15/42*** | (2006.01) |
| ***D06F 39/08*** | (2006.01) |
| ***D06F 39/10*** | (2006.01) |
| ***F04D 1/00*** | (2006.01) |
| ***F04D 13/06*** | (2006.01) |
| ***F04D 15/00*** | (2006.01) |
| ***F04D 29/22*** | (2006.01) |
| ***F04D 29/42*** | (2006.01) |
| ***F04D 29/70*** | (2006.01) |

(52) U.S. Cl.

CPC ..... *D06F 39/085* (2013.01); *A47L 15/4225* (2013.01); *D06F 39/083* (2013.01); *D06F 39/10* (2013.01); *F04D 13/06* (2013.01); *F04D 15/0005* (2013.01); *F04D 1/00* (2013.01); *F04D 29/22* (2013.01); *F04D 29/4293* (2013.01); *F04D 29/708* (2013.01)

(58) Field of Classification Search

CPC . A47L 15/4225; D06F 39/083; D06F 39/085; D06F 39/10; F04D 1/00; F04D 13/06; F04D 15/0005; F04D 29/22; F04D 29/4293; F04D 29/708

USPC ..... 134/56 D, 57 D, 58 D, 103.1, 108, 111, 134/174, 178, 184, 186, 195, 198

See application file for complete search history.

(56) References Cited

U.S. PATENT DOCUMENTS

2012/0260942 A1* 10/2012 Slabbekoorn ..... A47L 15/0031 134/10

* cited by examiner

*Primary Examiner* — Levon J Shahinian
(74) *Attorney, Agent, or Firm* — Akerman LLP

(57) ABSTRACT

The present invention relates to a discharge/recirculation system (1) for electric household appliances, comprising: a single pump assembly (10); which is selectively configurable to pump water from an intake path (7) either to a discharge path (8*a*) leading to the drains or to said recirculation path leading (8*b*) leading back to the washing chamber.

5 Claims, 13 Drawing Sheets

DISCHARGE/RECIRCULATION SYSTEM FOR HOUSEHOLD APPLIANCES

CROSS-REFERENCE TO RELATED APPLICATIONS

The present application claims priority to Chinese Patent Application No. 201610839945.1, filed Sep. 21, 2016, the entirety of which is incorporated herein by reference.

FIELD OF APPLICATION

The present invention relates to a discharge/recirculation system for electric household appliances.

Such a discharge/recirculation system is particularly suitable for use in laundry washing machines, although its use in dishwashers or other household appliances comprising a washing chamber or tab connected to an hydraulic circuit.

PRIOR ART

Household appliances such as washing machines or dishwashers typically include both a circuit for recirculation of the water through the washing tub or chamber and a circuit for discharging the resulting waste water toward the drains.

The recirculation circuit comprises a recirculation pump, while the discharge circuit comprises a discharge pump. Said pumps are usually centrifugal pumps with a bladed impeller driven by an electric motor, most commonly a synchronous electric motor.

Even though the above-described arrangement does meets the requirement of the field, the provision of two separate pumps weighs on the manufacturing and maintenance costs of the household appliance, and adds to the relative complexity of its design in terms of additional cabling, heat dissipation requirements, dimensional constraints.

The technical problem underlying the present invention is therefore that of devising an alternative arrangement that provides a reduction in the manufacturing costs and a simplification in the apparatus design.

SUMMARY OF THE INVENTION

The idea underlying the present invention, based on the observation that the discharge cycle is always alternative to the washing cycle, is that of using a single pump for pumping water both for recirculation and discharge purpose.

The technical problem described above is therefore solved by a discharge/recirculation system for electric household appliances, comprising: a pump assembly; an intake path departing from a washing chamber of an electric household appliance and leading to said pump assembly; a discharge path departing from said pump assembly and leading to a discharge port; a recirculation path departing from said pump assembly and leading back into said washing chamber; wherein said pump assembly is selectively configurable to pump water from said intake path either to said discharge path or to said recirculation path.

Preferably, the discharge/recirculation system also comprises a valve arrangement configured to switch the delivery of the pump assembly between said discharge path and said recirculation path.

In particular, said valve arrangement could be a single 3-way valve having a common inlet port connected to a delivery of said pump assembly and two alternative outlet ports connected to said discharge path and to said recirculation path.

Alternatively, said valve arrangement could comprise two 2-way valves, a first 2-way valve and a second 2-way valve respectively intercepting said discharge path and said recirculation path and configured so that said first 2-way valve is closed if the second 2-way valve is open, and that said second 2-way valve is closed if the first 2-way valve is open.

Said valve arrangement could also be advantageously integrated into the pump assembly. In this case, the valve(s) is(are) at least partially housed within the pump casing, and two separate delivery outlets open on the casing itself and respectively connect to the discharge path and the recirculation path.

The valves employed are preferably solenoid valves, but valves of different type could of course be chosen.

The discharge/recirculation system according to present invention further comprises a control unit configured to control said valve arrangement so that the pump assembly is connected to said recirculation path during a washing cycle condition of the electric household appliance, and that said pump assembly is connected to said discharge path during a discharge cycle condition of the electric household appliance; said washing cycle condition being alternative to said discharge cycle condition.

Said control unit could be for instance the local control unit of the pump assembly. Alternatively, the valve arrangement of the discharge/recirculation system could be controlled by the main control unit (motherboard) of the household appliance.

A preferred embodiment of the present invention considers a pump assembly having an electric motor, an impeller driven by said electric motor and a volute chamber wherein said impeller rotates.

The electric motor is preferably a permanent-magnet synchronous electric motor.

Said volute chamber preferably has an intake opening in fluid communication with the intake path, a first delivery opening connected to said discharge path and a second delivery opening connected to said recirculation path; said discharge/recirculation system further comprising an advantageous valve arrangement configured to switch the delivery of the pump assembly between said discharge path and said recirculation path.

A preferred embodiment of the present invention considers a pump assembly further comprising an inlet chamber, in fluid communication with said intake path and upstream said volute chamber, wherein said intake opening connects said inlet chamber to said volute chamber, said intake opening being provided with a mechanical filter; said pump assembly further comprising a removable watertight inspection cap closing said inlet chamber opposite to said mechanical filter.

Said cap could be advantageously removed in order to inspect the inlet chamber to remove any solid contaminants dragged by the water from said washing chamber and accumulated in the inlet chamber upstream said mechanical filter; removing the cap is also possible to clean up or replace the mechanical filter.

The technical problem described above is also solved by an electric household appliance, comprising a washing chamber for temporarily housing at least one article to be washed, a water intake port connectable to a water distribution network and in fluid communication with said washing chamber and a discharge port connectable to a drainage network; said electric household appliance comprising a discharge/recirculation system according to the present invention, wherein said intake path connects the washing chamber to the intake of the pump assembly, said recirculation path connects the delivery of the pump assembly back to said washing chamber and said discharge path connects said delivery of the pump assembly to the discharge port.

Advantages of the above-described solution are the reduction in manufacturing cost and complexity of the appliance.

Further characteristics and advantages of the invention will become clear from the following description of specific embodiments given by way of non-limiting examples, with reference to the enclosed drawings.

DETAILED DESCRIPTION

Figure 1:
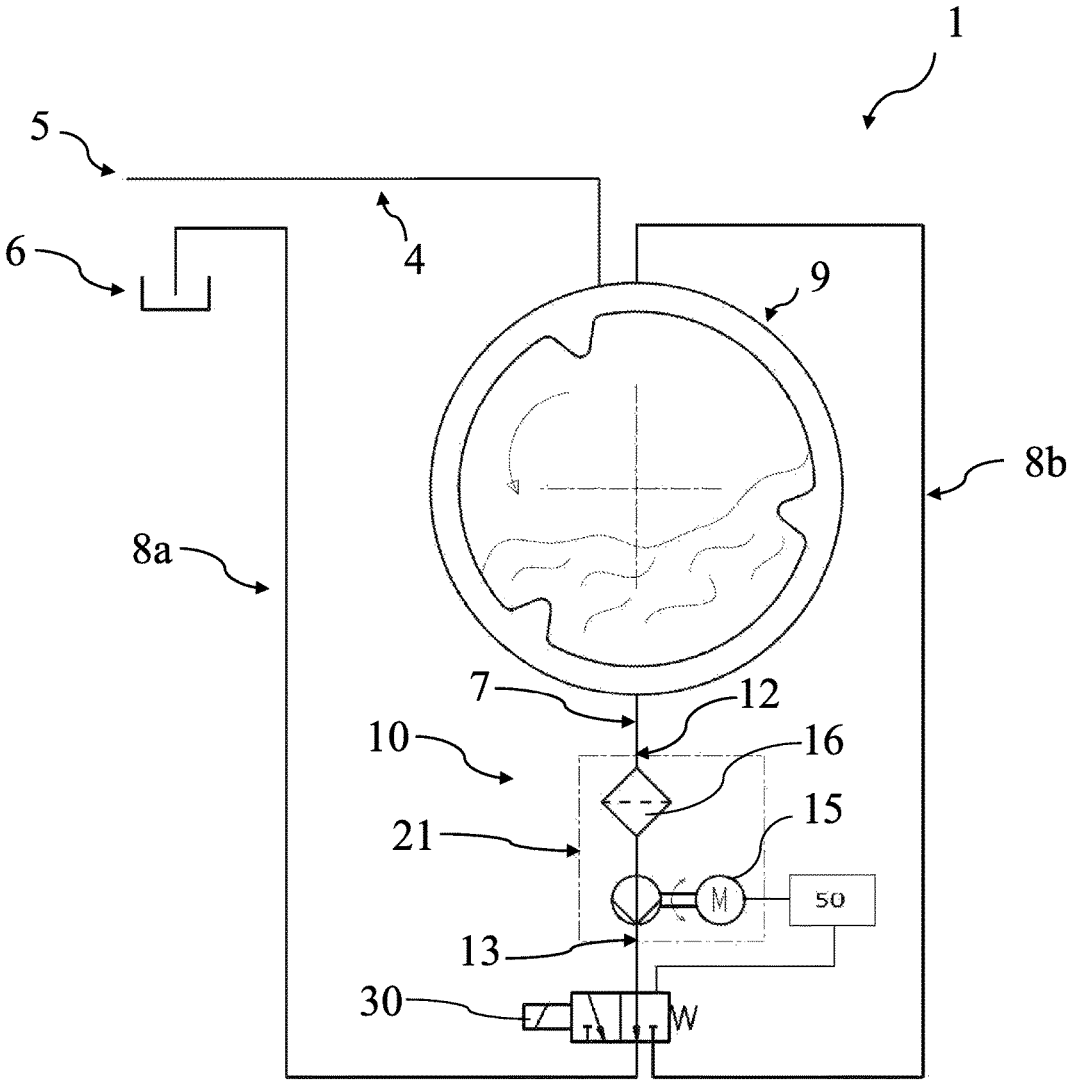
FIG. 1 shows a scheme of a discharge/recirculation system according to a first embodiment of the present invention.

With reference to the above-described figures, five alternative embodiments of a discharge/recirculation system according to the present invention are respectively designated with reference number 1, 1', 1", 1''', 1''''.

Although use of the device in related applications may be envisaged, the above-mentioned system is specifically designed for use in electric household appliances, in particular domestic or industrial laundry washing machines.

Indeed, the embodiments herein described apply to a washing machine comprising a washing chamber or tub 9, wherein article of clothing are temporarily housed for washing purpose, a water intake port 5 connected to a water distribution network and connected to said washing chamber 9 through a water supply path 4, and a discharge port 6 connectable to the drains.

The washing machine also comprises a discharge path 8*a* leading to the discharge port 6 for draining dirty water coming from the washing chamber 9 during a discharge cycle, and a recirculation path 8*b* leading to the washing chamber 9 allowing the recirculation of the water coming from the washing chamber 9 back to said washing chamber 9 during a washing cycle.

The discharge/recirculation system 1, 1', 1", 1''', 1'''' according to the present invention comprises a single pump assembly 10, 10', 10", 10''' and a valve arrangement.

Said valve arrangement is configured to switch the delivery of the pump assembly 10, 10', 10", 10''' between the discharge path 8*a* during a discharge cycle and the recirculation path 8*b* during a washing cycle. Said switching is controlled by a control unit 50; in the embodiments herein described the control unit 50 is a local control unit of the pump assembly 10, 10', 10", 10'''. Alternatively the valve arrangement of the discharge/recirculation system 1, 1', 1", 1''', 1'''' could be controlled by the main control unit (motherboard) of the washing machine.

With reference to FIG. 1, a first specific embodiment of the discharge/recirculation system according to the present invention is identified with reference number 1.

In said embodiment, the valve arrangement is composed by a single 3-way valve 30 having an inlet port connected to a delivery opening 13 of the pump assembly 10 and two alternative outlet ports respectively connected to the discharge path 8*a* and to the recirculation path 8*b*. The control unit 50 allows the commutation of the valve 30 between to two alternative configurations connecting the pump assembly 10 respectively to the discharge path 8*a* and to the recirculation path 8*b*.

The pump assembly 10 adopted in said discharge/recirculation system is specifically shown in FIGS. 3-6.

The pump assembly 10 comprises a single phase permanent-magnet electric motor 15 driving an impeller 14 about a rotor axis. A volute chamber, attached to the body of the electric motor 15, houses the impeller 14; and laterally opens in a delivery opening 13.

An inlet chamber 20 axially extends the volute chamber along the direction of the rotor axis. An inlet opening 21, laterally opening on the inlet chamber 20, is connected to the washing chamber 9 via an intake path 7. The inlet chamber 20 and the volute chamber communicate through an axial intake opening 12, at which a mechanical filter 16 is provided. A removable watertight inspection cap 22, opposite to the mechanical filter 16 closes the inlet chamber 20.

Alternative embodiments of the discharge/recirculation system according to the invention are described in the following. In the description of these embodiments, same or functionally similar features or elements are identified with the same reference numbers previously adopted. In the absence of any indication to the contrary, the previous description applies, mutatis mutandis, to similar elements in the alternative embodiments.

Figure 2:
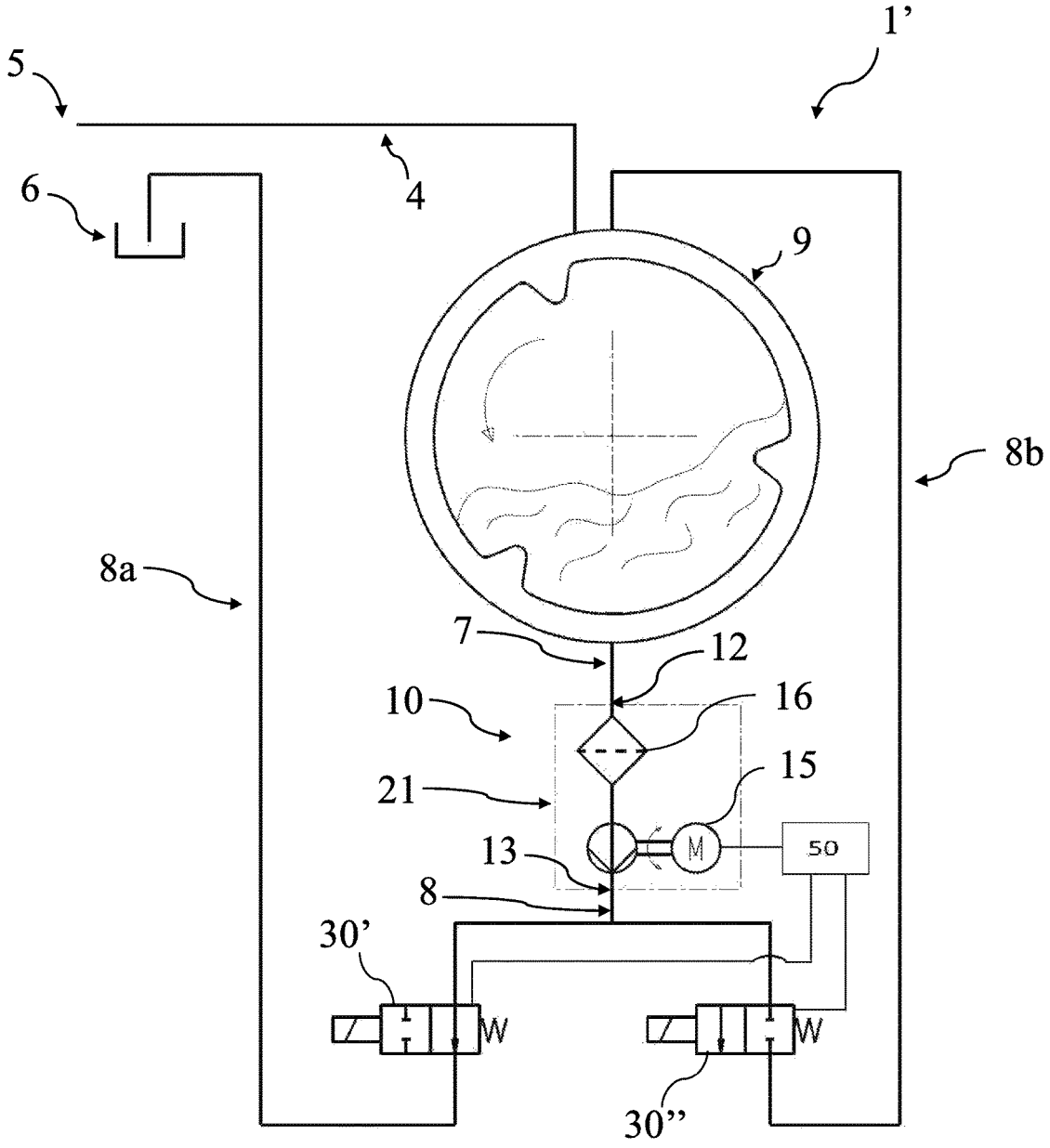
FIG. 2 shows a scheme of a discharge/recirculation system according to a second embodiment of the present invention.
Figure 3:
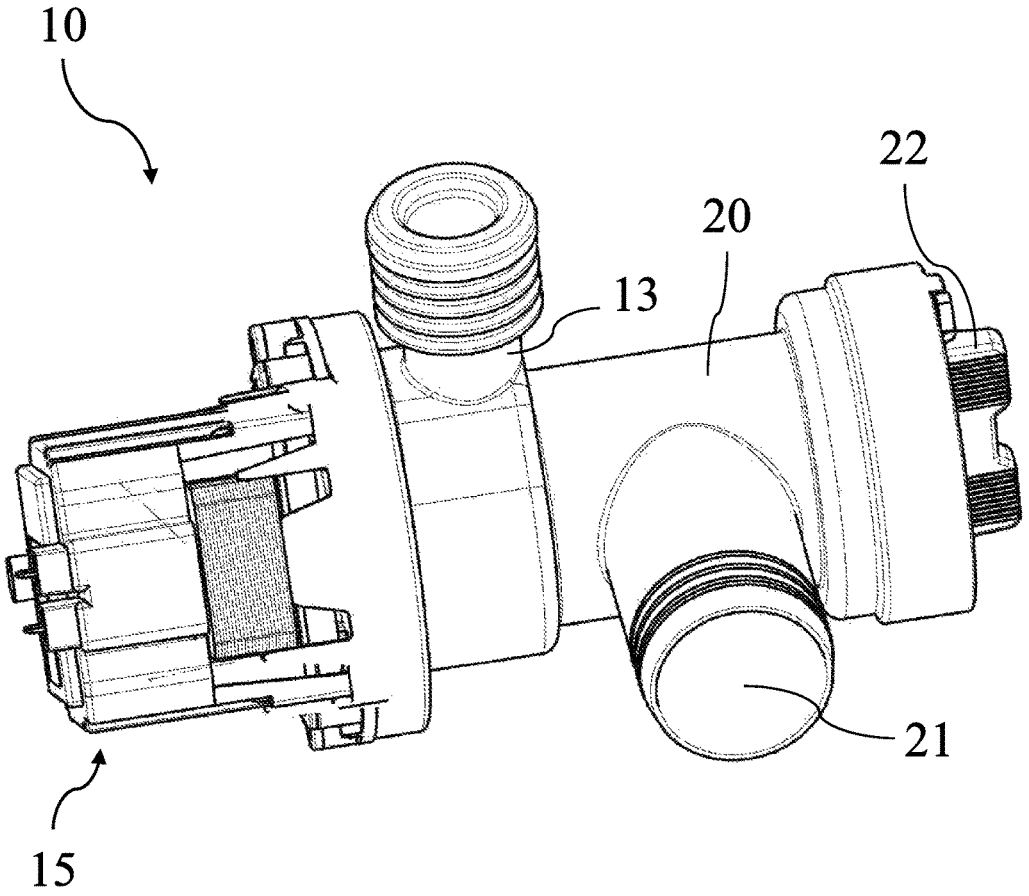
FIG. 3 shows a perspective view of a pump assembly comprised in both the discharge/recirculation systems of FIG. 1 and FIG. 2.
Figure 4:
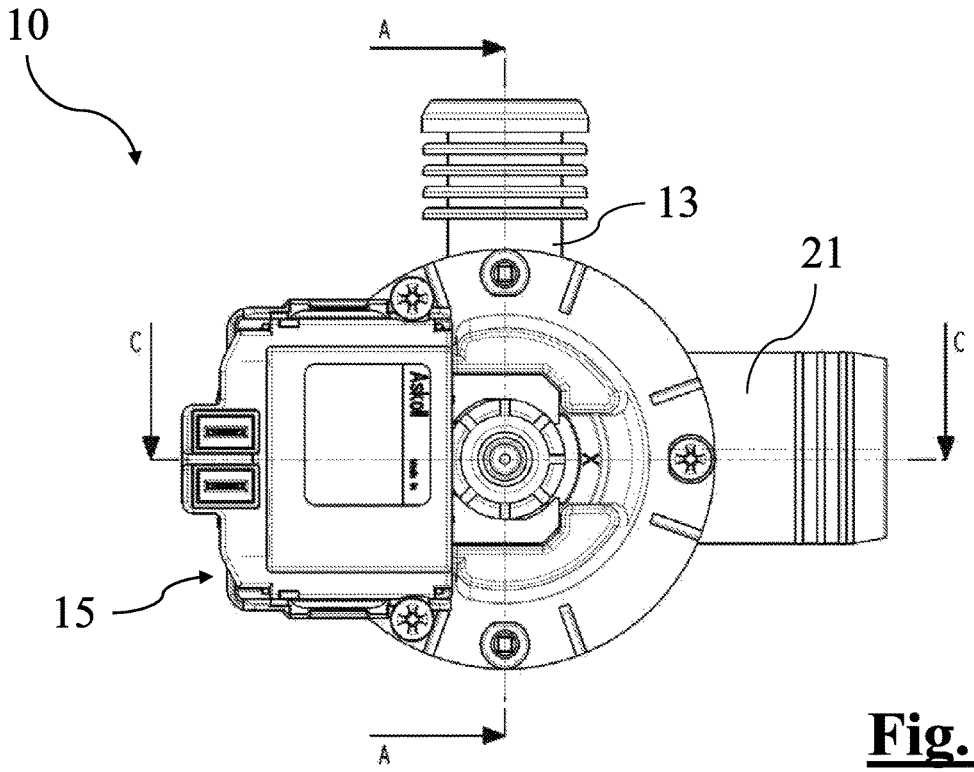
FIG. 4 shows a plan view of the pump assembly of FIG. 3.
Figure 5:
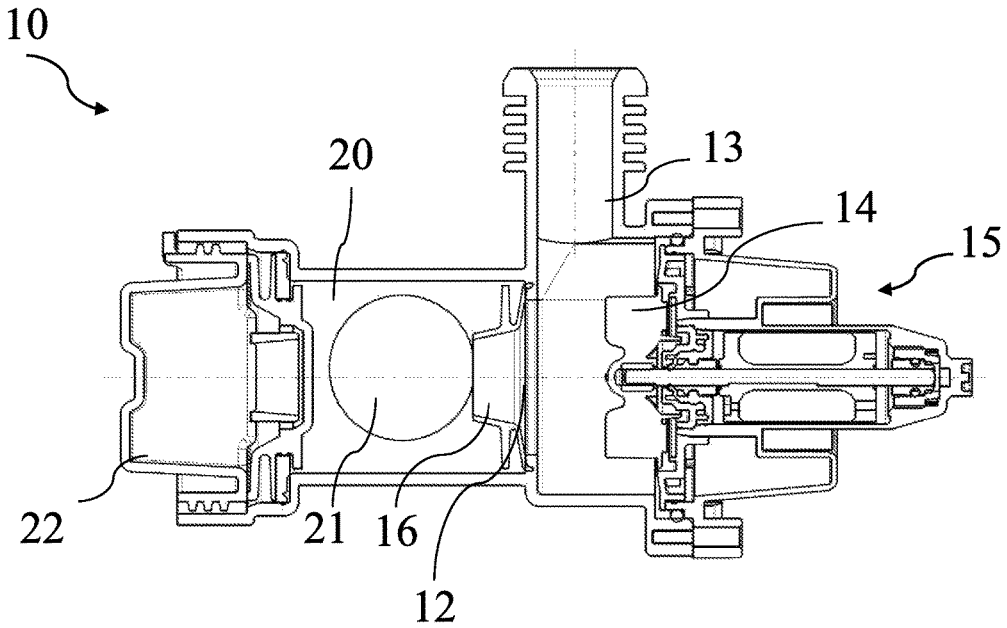
FIG. 5 shows a side view, sectioned along a plane A-A, of the pump assembly of FIG. 3.
Figure 6:
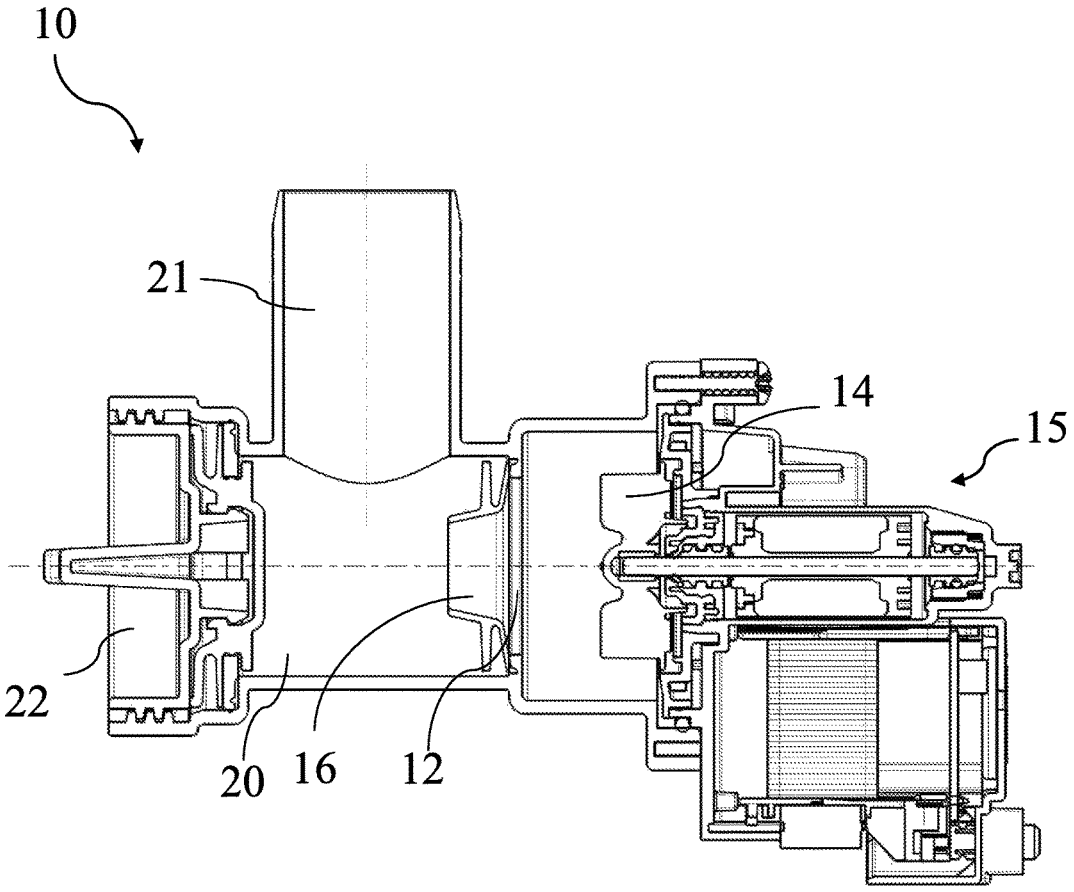
FIG. 6 shows a side view, sectioned along a plane C-C, of the pump assembly of FIG. 3.

With reference to FIG. 2, a second embodiment of the discharge/recirculation system according to the present invention is identified with reference number 1'.

The second embodiment employs the same pump assembly 10 previously described with reference to the first embodiment. However, instead of a single valve, the valve arrangement comprises a first 2-way valve 30' and a second 2-way valve 30".

The delivery opening 13 of the pump assembly 10 is connected to a common portion 8 shared by both the discharge path 8*a* and the recirculation 8*b* path. The two paths bifurcate at a juncture downstream the delivery opening 13. The first 2-way valve 30' is located alongside the discharge path 8*a* downstream the common path 8, and the second 2-way valve 30" is located alongside the recirculation path 8*b* downstream the common path 8.

The control unit 50 controls both the first 2-way valve 30' and the second 2-way valve 30", in such a way as to open either the one or the other valve. Depending on which of the two valves is set open, the water flow coming from the pump assembly 10 will be either discharged through the discharge path 8*a* or sent back to the tub through the recirculation path 8*b*.

Figure 7:
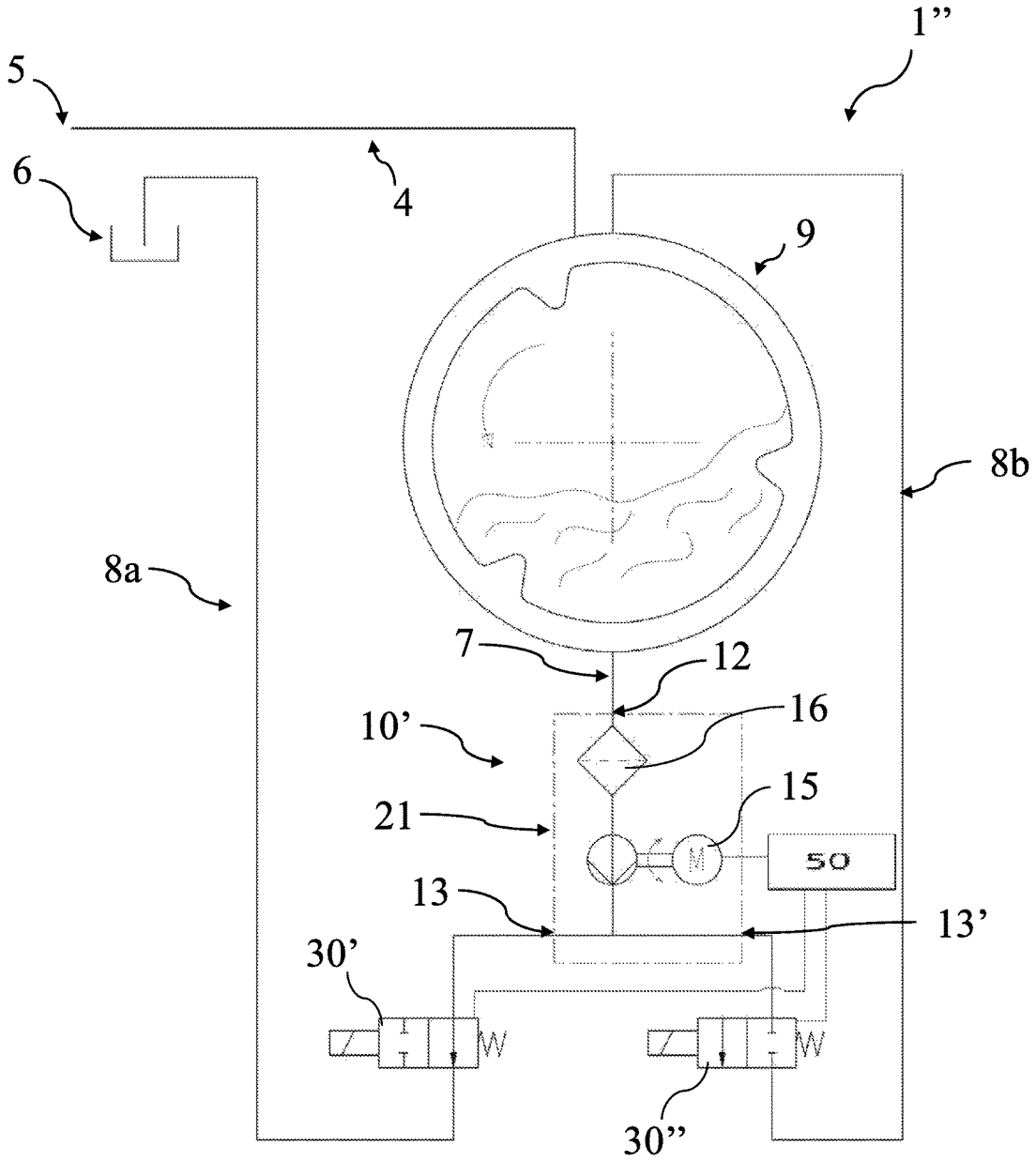
FIG. 7 shows a scheme of a discharge/recirculation system according to a third embodiment of the present invention.
Figure 8:
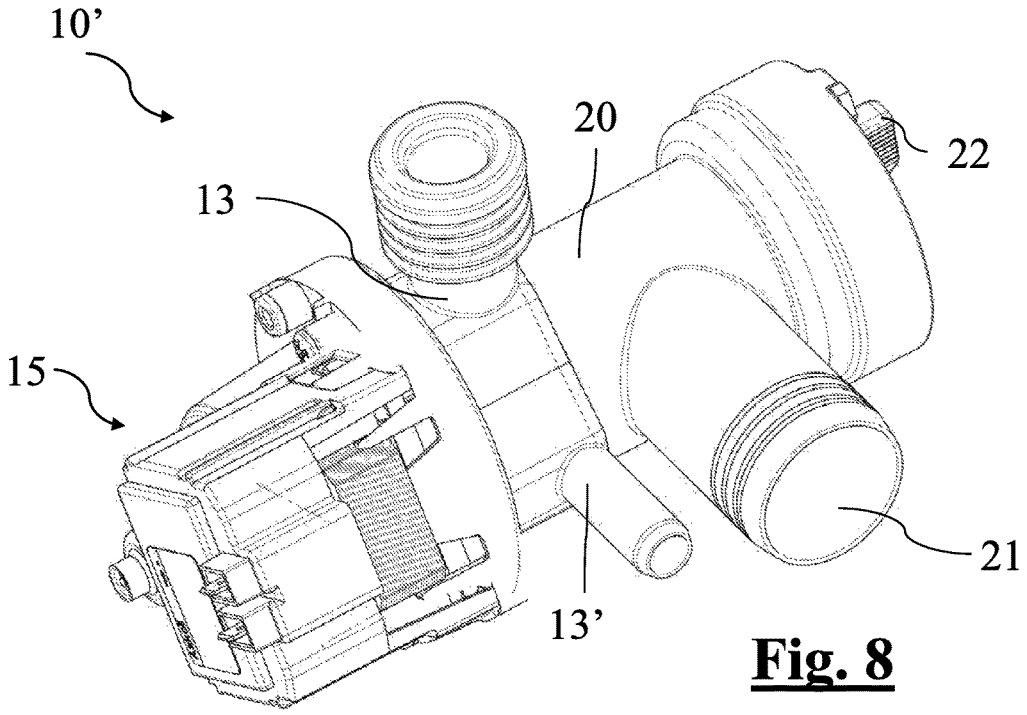
FIG. 8 shows a perspective view of a pump assembly comprised in the discharge/recirculation system of FIG. 7.
Figure 9:
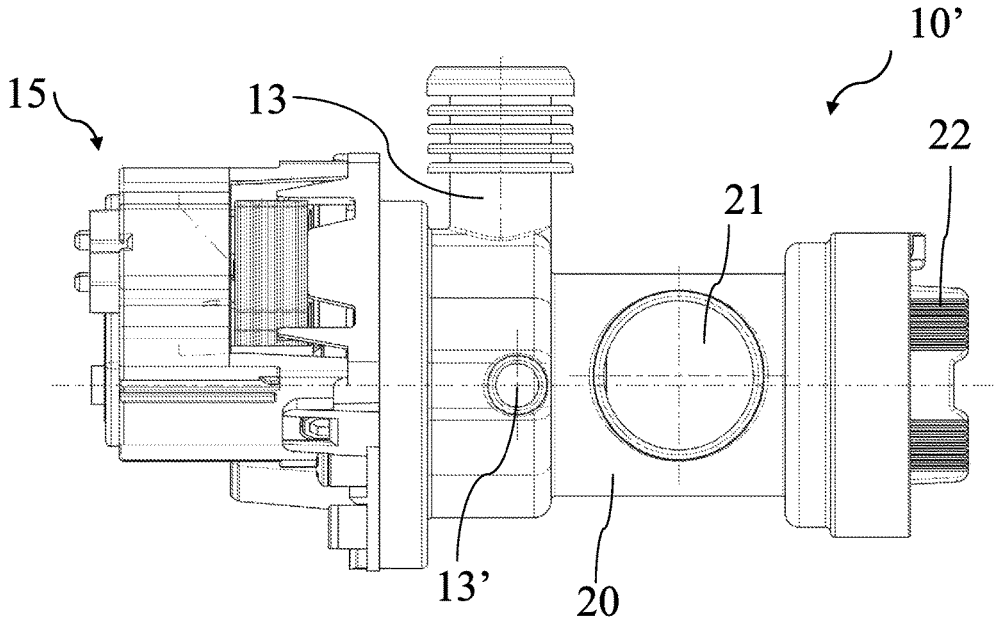
FIG. 9 shows a side view of the pump assembly of FIG. 8.
Figure 10:
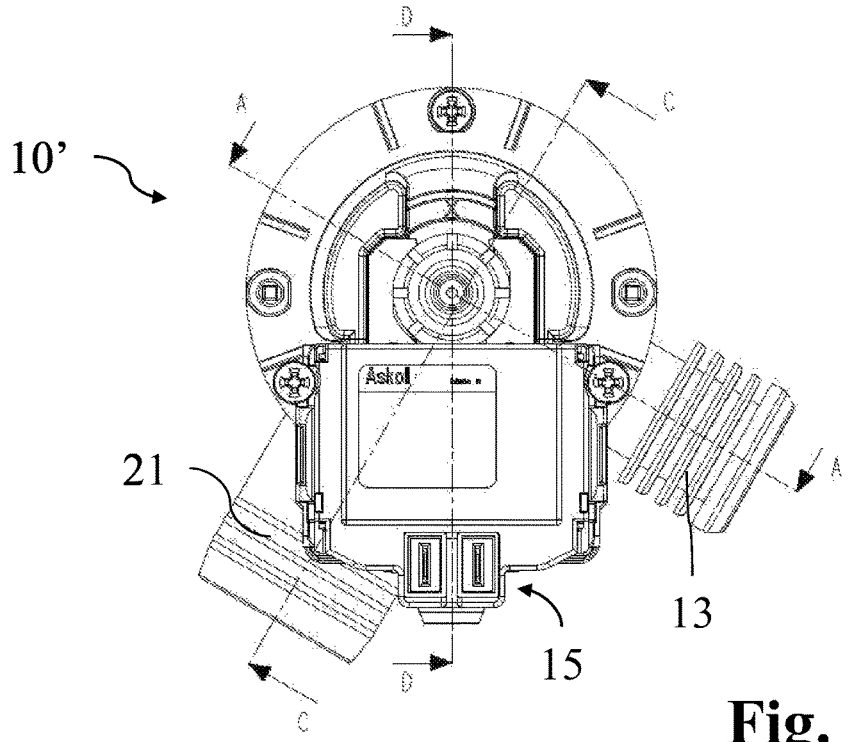
FIG. 10 shows a plan view of the pump assembly of FIG. 8.
Figure 11:
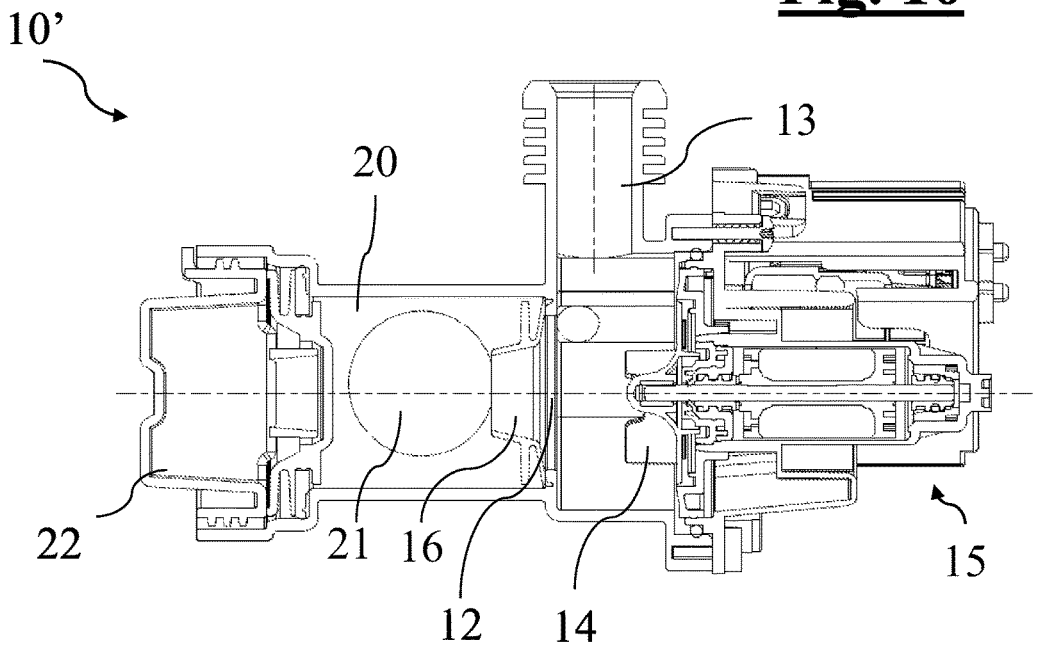
FIG. 11 shows a side view, sectioned along a plane A-A, of the pump assembly of FIG. 10.
Figure 12:
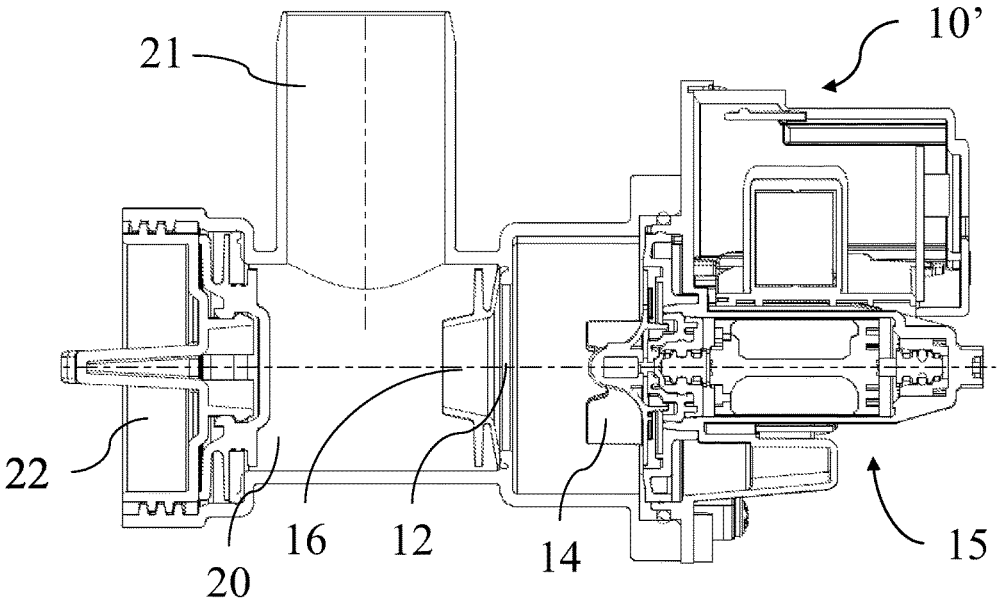
FIG. 12 shows a side view, sectioned along a plane C-C, of the pump assembly of FIG. 10.
Figure 13:
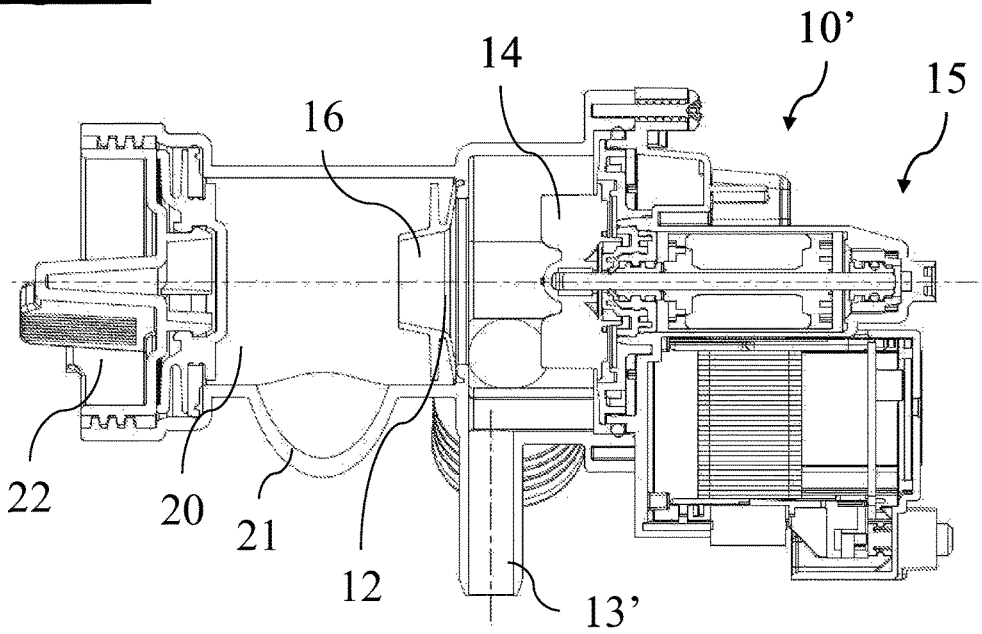
FIG. 13 shows a side view, sectioned along a plane D-D, of the pump assembly of FIG. 10.

With reference to FIG. 7, a third embodiment of the discharge/recirculation system according to the present invention is identified with reference number 1".

Said third embodiment differs from the second embodiment only in that the pump assembly 10', shown in FIGS. 8-13, has a second delivery opening 13' also opening on the lateral wall of the volute chamber alongside the first delivery opening 13. The discharge path 8*a* and the recirculation path 8*b* respectively leave from said first delivery opening 13 and second delivery opening 13'.

Figure 14:
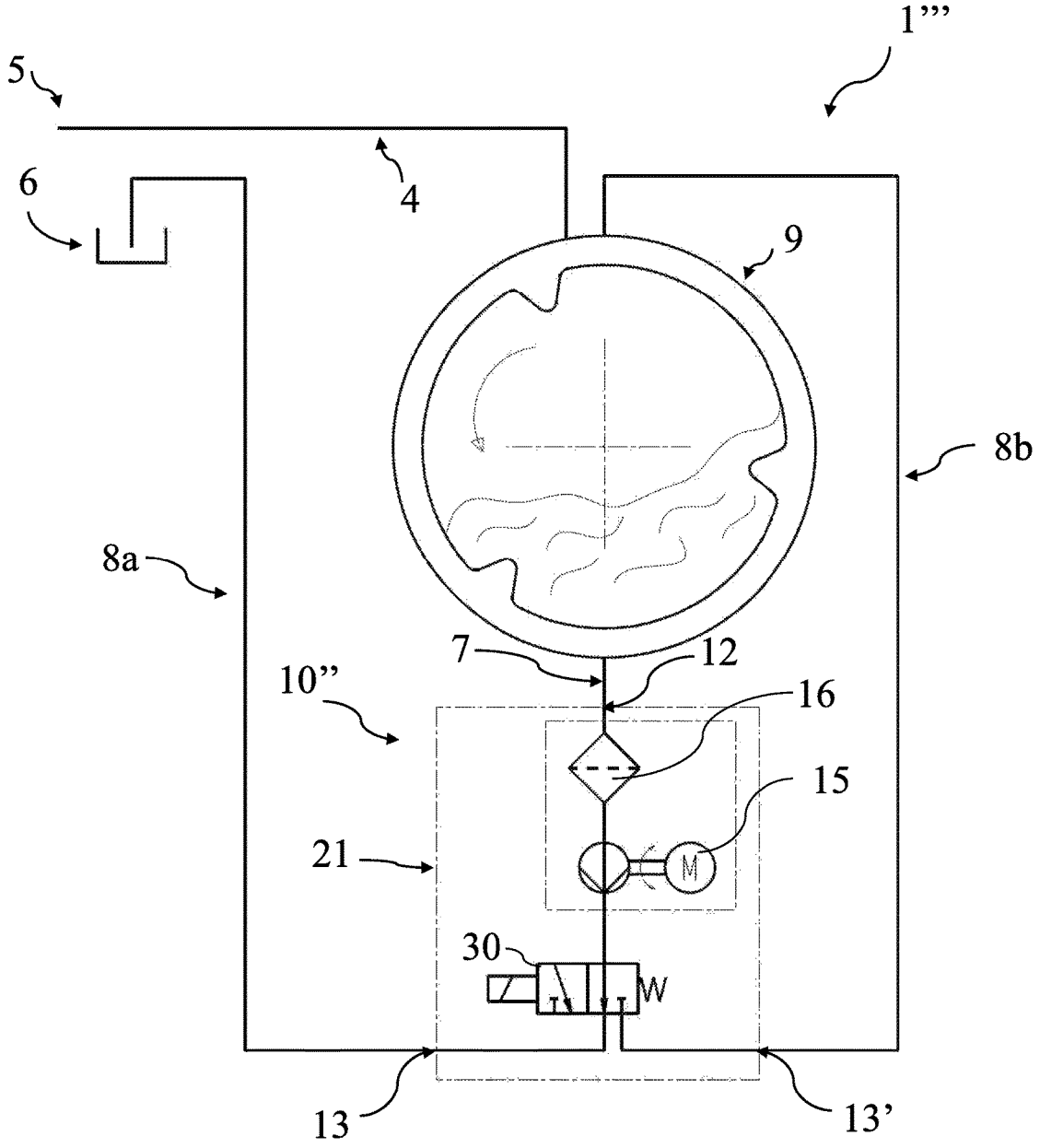
FIG. 14 shows a scheme of a discharge/recirculation system according to a fourth embodiment of the present invention.

With reference to FIG. 14, a fourth embodiment of the discharge/recirculation system according to the present invention is identified with reference number 1'".

Figure 15:
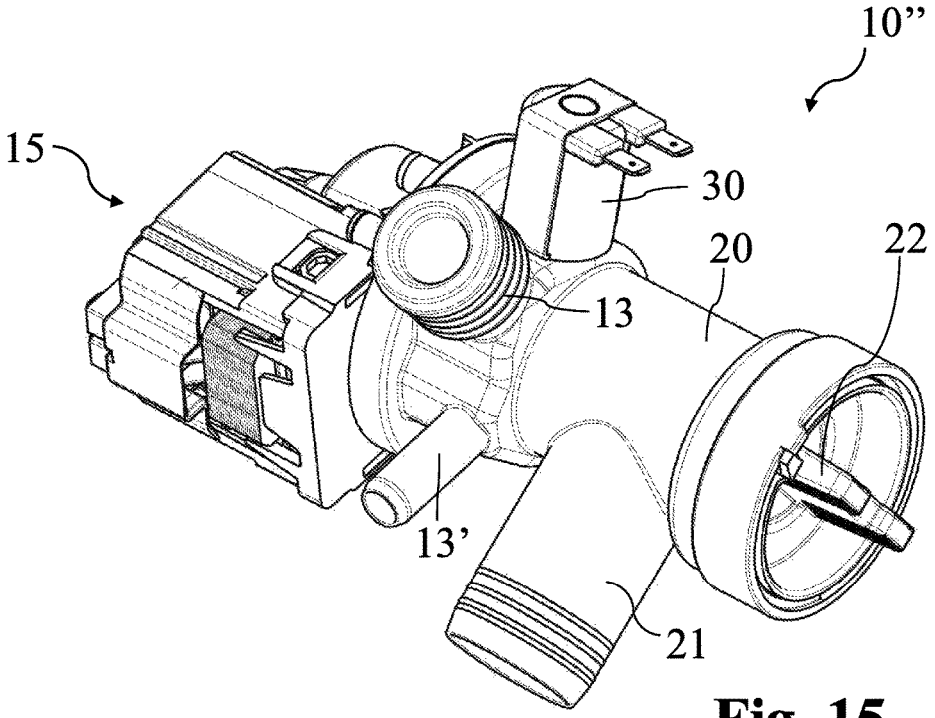
FIG. 15 shows a perspective view of a pump assembly included in the discharge/recirculation system of FIG. 14.
Figure 16:
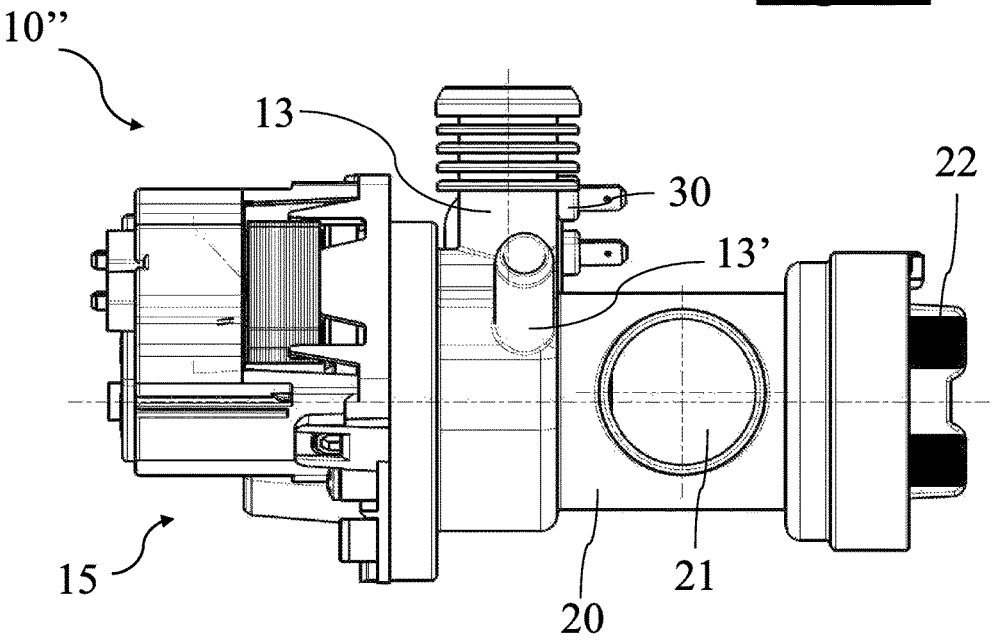
FIG. 16 shows a side view of the pump assembly of FIG. 15.

This embodiment resembles the first embodiment in that the valve arrangement comprises a single 3-way valve 30; however, in the present case the valve is integrated into the pump assembly 10", shown in FIGS. 15 and 16, and partially housed within the pump casing.

The integrated 3-way valve 30 has an inlet port in flow communication with intake opening 12 of the pump assembly 10" and two alternative outlet ports connected respectively to the first delivery opening 13 and to the second delivery opening 13'.

Figure 17:
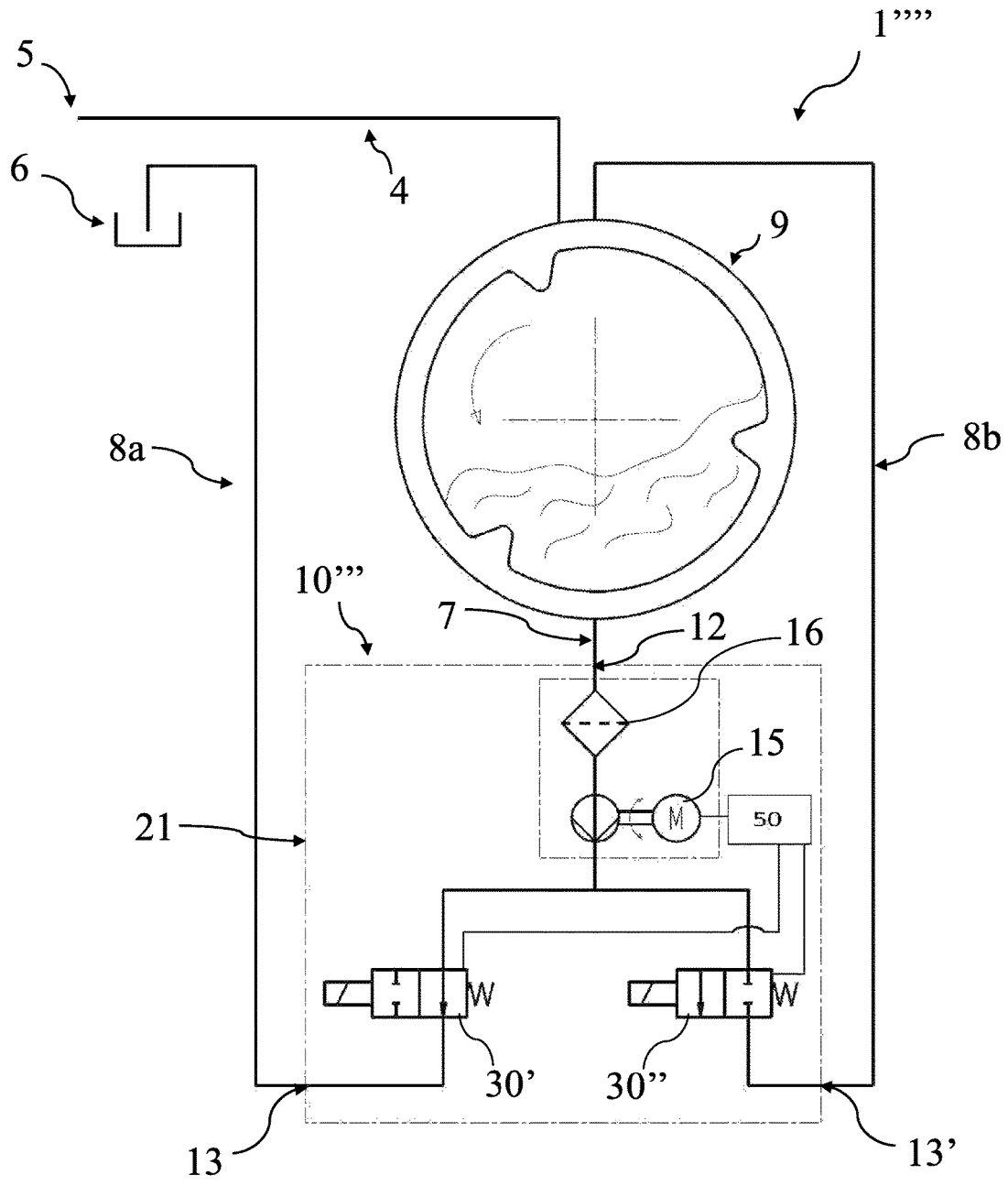
FIG. 17 shows a scheme of a discharge/recirculation system according to a fifth embodiment of the present invention.

With reference to FIG. 17, a fifth embodiment of the discharge/recirculation system according to the present invention is identified with reference number 1"".

Figure 18:
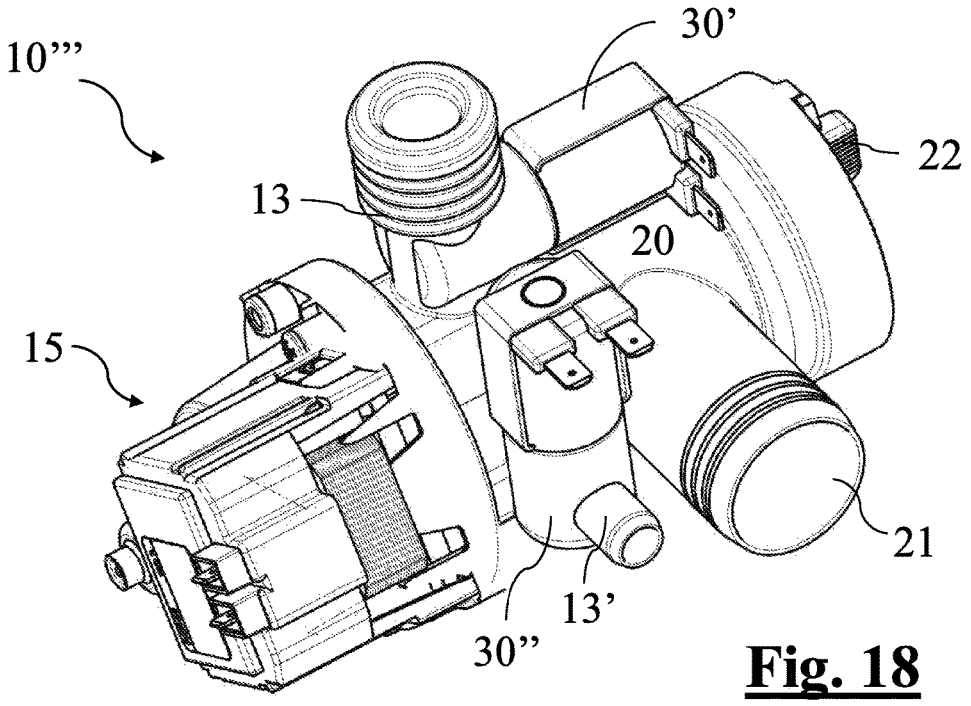
FIG. 18 shows a perspective view of a pump assembly included in the discharge/recirculation system of FIG. 17.
Figure 19:
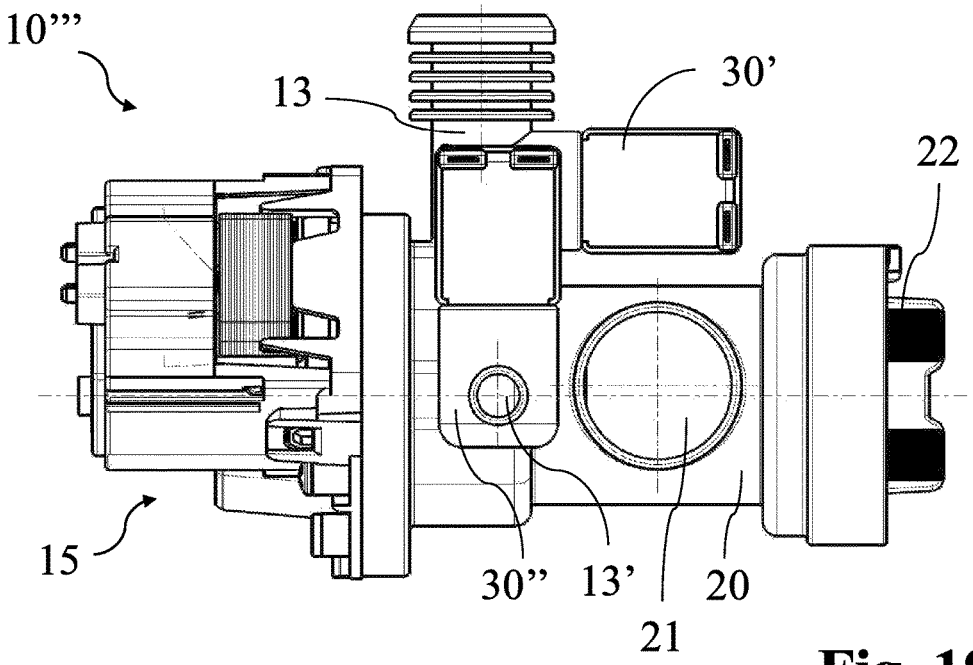
FIG. 19 shows a side view of the pump assembly of FIG. 18.

This embodiment resembles the second embodiment in that the valve arrangement comprises a first 2-way valve 30' and a second 2-way valve 30"; however, the valves are directly integrated into the pump assembly 10'", shown in FIGS. 18 and 19.

In particular, the valves directly intercept a duct portion within the fittings of the first and second delivery openings 13, 13'.

Note that, in the fourth and fifth embodiment of the discharge/recirculation system 1'", 1"", the whole system comprising the pump assembly 10", 10'" and the valve arrangement is conveniently integrated into a single unit, which can advantageously be installed in a single step.

Obviously a person skilled in the art can apply numerous modifications and variations to the devices described above to meet with specific and contingent needs; these would, nevertheless all fall within the scope of protection of the invention as described in the following claims.

The invention claimed is:

1. A discharge/recirculation system for electric household appliances, comprising:

a single pump comprising, within:

a pump casing;

an electric motor;

an impeller driven by said electric motor;

a volute chamber wherein said impeller rotates;

a single intake opening;

a first delivery opening;

a second delivery opening;

a first internal 2-way valve intercepting a first duct portion leading from the volute chamber to the first delivery opening; and a second internal 2-way valve intercepting a second duct portion leading from the volute chamber to the second delivery opening;

the discharge/recirculation system further comprising an intake path departing from a washing chamber of an electric household appliance and leading to the intake opening of said pump;

a discharge path departing from the first delivery opening of said pump and leading to a discharge port;

a recirculation path departing from the second delivery opening of said pump and leading back into said washing chamber; and a control unit configured to control said first internal 2-way valve and said second internal 2-way valve so that the first internal 2-way valve is closed and the second internal 2-way valve is open, thereby the pump delivering fluid to said recirculation path, during a washing cycle condition of the electric household appliance; and that the first internal 2-way valve is open and the second internal 2-way valve is closed, thereby the pump delivering fluid to said discharge path, during a discharge cycle condition of the electric household appliance; said washing cycle condition being alternative to said discharge cycle condition.

2. The discharge/recirculation system according to claim 1, wherein said pump further comprises an inlet chamber, in fluid communication with said intake path and upstream said volute chamber, wherein said intake opening connects said inlet chamber to said volute chamber, said intake opening being provided with a mechanical filter; said pump further comprising a removable watertight inspection cap closing said inlet chamber opposite to said mechanical filter.

3. An electric household appliance, comprising a washing chamber for temporarily housing at least one article to be washed, a water intake port connectable to a water distribution network and in fluid communication with said washing chamber and a discharge port connectable to a drainage network;

said electric household appliance comprising a discharge/recirculation system according to claim 1, wherein said intake path connects the washing chamber to the intake opening of the pump, said recirculation path connects the second delivery opening of the pump back to said washing chamber and said discharge path connects said first delivery opening of the pump to the discharge port.

4. The discharge/recirculation system according to claim 1, wherein the first internal 2-way valve intercepts a first cylindrical fitting, protruding from a pump body, defining at its end the first delivery opening; and the second internal 2-way valve intercepts a second cylindrical fitting, protruding from the pump body, defining at its end the second delivery opening.

5. A discharge/recirculation system for electric household appliances, comprising:

a single pump comprising, within: a pump casing;

an electric motor;

an impeller driven by said electric motor;

a volute chamber wherein said impeller rotates;

a single intake opening;

a first delivery opening;

a second delivery opening; and an internal 3-way valve, housed within said pump casing, said internal 3-way valve having an inlet port in flow communication with the volute chamber and two alternative outlet ports connected respectively to the first delivery opening and to the second delivery opening;

said discharge/recirculation system further comprising an intake path departing from a washing chamber of an electric household appliance and leading to the intake opening of said pump; a discharge path departing from the first delivery opening of said pump and leading to a discharge port;

a recirculation path departing from the second delivery opening of said pump and leading back into said washing chamber; and a control unit configured to control said internal 3-way valve so that the pump delivers fluid to the second delivery opening, and therefore to said recirculation path, during a washing cycle condition of the electric household appliance; and that the internal 3-way valve delivers fluid to said first delivery opening, and therefore to said discharge path, during a discharge cycle condition of the electric household appliance;

said washing cycle condition being alternative to said discharge cycle condition.

* * * * *